US009034173B2

(12) United States Patent
Dorrer

(10) Patent No.: US 9,034,173 B2
(45) Date of Patent: May 19, 2015

(54) MICROFLUIDIC DIELECTROPHORESIS SYSTEM

(71) Applicant: Christian Dorrer, Stuttgart (DE)

(72) Inventor: Christian Dorrer, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/147,663

(22) Filed: Jan. 6, 2014

(65) Prior Publication Data

US 2014/0116882 A1 May 1, 2014

Related U.S. Application Data

(62) Division of application No. 12/931,938, filed on Feb. 14, 2011, now abandoned.

(30) Foreign Application Priority Data

Mar. 18, 2010 (DE) ..... 10 2010 003 001

(51) Int. Cl.
*B03C 3/017* (2006.01)
*B03C 5/00* (2006.01)
*B03C 5/02* (2006.01)

(52) U.S. Cl.
CPC ..... *B03C 5/005* (2013.01); *B03C 5/026* (2013.01); *B03C 2201/26* (2013.01)

(58) Field of Classification Search
CPC ..... B03C 5/00–5/028
USPC ..... 204/643
See application file for complete search history.

(56) References Cited

U.S. PATENT DOCUMENTS

2005/0273995 A1 12/2005 Kanagasabapathi et al.

FOREIGN PATENT DOCUMENTS

EP 1 154 856 11/2001
WO WO 97/07245 2/1997

OTHER PUBLICATIONS

Michael P. Hughes: "Strategies for dielectrophoretic separation in laboratory-on-a-chip systems," Electrophoresis 2002, 23, pp. 2569-2582.

Nitzan Gadish and Joel Voldman, High-Throughput Positive-Dielectrophoretic Bioparticle Microconcentrator, Anal. Chem. 2006, 78, pp. 7870-7876.

*Primary Examiner* — J. Christopher Ball
(74) *Attorney, Agent, or Firm* — Kenyon & Kenyon LLP

(57) ABSTRACT

A microfluidic dielectrophoresis system includes: one supply device for a liquid medium having particles contained therein, N≥2 microfluidic, dielectrophoretically active channels, which are equipped with electrodes, lines for the fluidic connection of the supply device to the channels, for the connection of the channels to one another, and for the drainage of the medium and/or the particles from the channels, and valves for setting the flow direction of the medium in the lines, the dielectrophoretically active channels being situated and being connected by lines in such a way that they may be operated connected in parallel and in series by switching the valves in relation to the flow direction of the medium and the electrodes of the various channels are activatable independently of one another.

7 Claims, 2 Drawing Sheets

MICROFLUIDIC DIELECTROPHORESIS SYSTEM

CROSS-REFERENCE TO RELATED APPLICATIONS

The present application is a divisional application of U.S. patent application Ser. No. 12/931,938, filed on Feb. 14, 2011, which claims priority to German Patent Application No. 10 2010 003 001.5, filed on Mar. 18, 2010, the contents of all of which are hereby incorporated by reference in their entireties.

BACKGROUND OF THE INVENTION

1. Field of the Invention

The present invention relates to a microfluidic dielectrophoresis system, in particular for the accumulation and/or concentration of dielectric, polarizable particles from a liquid medium, the use thereof, and a method for performing a dielectrophoresis, in particular for the accumulation and/or concentration of polarizable particles from a liquid medium, in particular using a microfluidic dielectrophoresis system.

2. Description of Related Art

An important area of application of dielectrophoresis is the concentration and separation of polarizable particles from a suspension. The particles may be manipulated in a fluidic channel, which is equipped with electrodes, as a flow cell. An inhomogeneous electrical field is produced by the electrodes during the dielectrophoresis by applying an AC voltage. A dipole moment, which interacts with the applied field, is induced by the inhomogeneous electrical field in the polarizable particles. The particles move either into areas of higher (positive DEP) or lower (negative DEP) field strength gradients due to a dielectrophoretic force field and may be accumulated therein in a "field cage" if necessary. Inter alia, a method has been established for the concentration of particles in which the polarizable particles are held back by positive dielectrophoresis (pDEP), while new sample volume is continuously conducted through the flow cell. After the electrode voltage, and therefore the dielectrophoretic force, is turned off, the particles may be flushed out in collected form. Because of the short range of the electrical field, microfluidic systems suggest themselves in particular for implementing the described functional principle. A typical construction of such a microfluidic system includes a microfluidic chip, which is equipped with a dielectrophoretically active channel part, which is equipped with electrodes, as a flow cell and with supply line channels. Such constructions are described, for example, in the technical publications "Strategies for dielectrophoretic separation in laboratory-on-a-chip systems" (Hughes, M. P. Electrophoresis 2002, 23, 2569) and "High-Throughput Positive-Dielectrophoretic Bioparticle Microconcentrator" (Gadish, N.; Voldman, J. Anal. Chem. 2006, 78, 7870) and the literature cited therein. A microfluidic channel system may be contacted with further components via flexible tubing. The sample volumes may be supplied from a reservoir using injector pumps or peristaltic pumps. Liquid which is no longer required may be conducted into a waste reservoir.

Such dielectrophoresis (DEP) chips, which may allow the selective separation and concentration of polarizable particles, for example, polymer particles or bioparticles, such as viruses, bacteria, or cells, possibly from complex substance mixtures, for example, for a subsequent analysis, are currently of interest in research and development. With respect to biotechnological applications, the problem often exists that bacteria, viruses, or cells must be extracted from a comparatively large sample volume. In order to conduct large liquid quantities (milliliters) through a microfluidic system in an acceptable time, comparatively large channel cross-sections and therefore large channel volumes are required. As a result, not all particles are reached by the dielectrophoretic force field and the liquid quantity required for the final flushing of the particles out of the particular channel is in turn relatively large, which limits the achievable particle concentration, and reduces the efficiency of the concentration in relation to a channel having smaller volume.

A device for the sequencing of polynucleotides is proposed in published international patent application document WO 97/07245, in which the samples may be fed using a distributor unit into separation channels which are operated in parallel and may be processed simultaneously therein, for example, separated.

SUMMARY OF THE INVENTION

The present invention proposes providing a dielectrophoresis system which includes at least

- one supply device for a liquid medium having particles contained therein,
- $N \geq 2$ microfluidic, dielectrophoretically active channels $K_n$, which are equipped with electrodes, where $1 \leq n \leq N$,
- lines for the fluidic connection of the supply device to the channels, for the connection of the channels to one another, and for the drainage of the medium and/or the particles from the channels, and
- valves for setting the flow direction of the medium in the lines, the dielectrophoretically active channels being situated and being connected by lines in such a way that they may be operated connected in parallel and in series by switching the valves in relation to the flow direction of the medium, and the electrodes of the various channels being activatable independently of one another.

In other words, the dielectrophoretically active channels of the dielectrophoresis system of the present invention may be operated both in a parallel connection and also, alternatively thereto, in a series connection, in relation to the flow of the medium. The changeover between the parallel connection and the series connection may be controlled in a targeted manner according to the present invention via the valve setting.

According to the present invention, a higher throughput of sample volume, i.e., the medium having polarizable particles contained therein, may be made possible using the parallel connection of the dielectrophoretically active channels. In an accumulation phase, the accumulation of polarizable particles in the microfluidic channels may additionally occur at higher efficiency. It is possible through the possible series connection of these channels and the independent control of the electrodes and thus of the individual dielectrophoretic force fields to selectively release the particles accumulated in the individual channels by turning off the voltage at the electrodes and to collect the particles in a channel connected downstream in the flow direction, in which the dielectrophoretic force is still active. The particles which are accumulated and concentrated once again in this manner may be flushed out in collected form from this channel. In other words, an additional concentration effect may be achieved in a separate concentration phase.

BRIEF DESCRIPTION OF THE DRAWINGS

The present invention is explained hereafter on the basis of exemplary embodiments in connection with the figures, without being restricted to the embodiments shown.

DETAILED DESCRIPTION OF THE INVENTION

Figure 1:
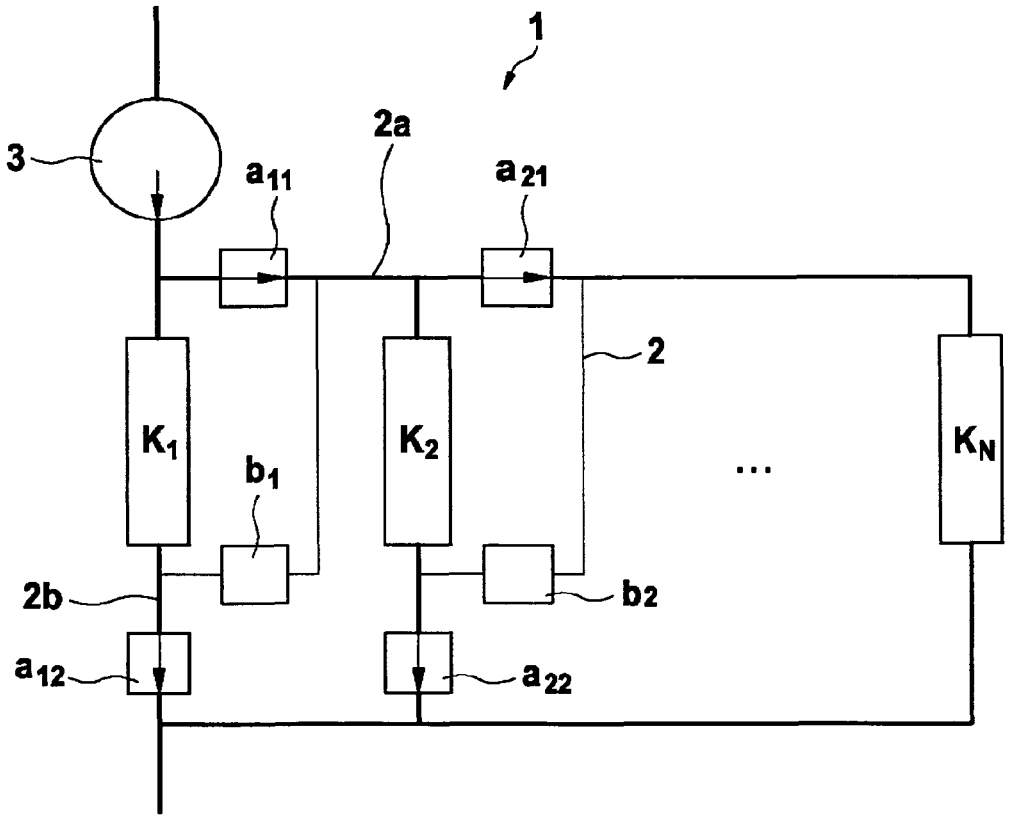
FIG. 1 shows a schematic construction of a microfluidic dielectrophoresis system according to the present invention having channels connected in parallel.

Dielectrophoretically active channels are understood according to the present invention as microfluidic channels which are equipped with electrodes and in which a dielectrophoretic force field may be produced at least in a partial area by application of a voltage to the electrodes. In other words, the dielectrophoretically active channels are flow cells or chambers through which a sample volume, for example, a suspension or solution having polarizable particles contained therein, may be conducted, in particular continuously. In this case, the polarizable particles in the sample volume which is flowing past may be manipulated by the dielectrophoretic force field.

The electrodes for producing the dielectrophoretic force field may be electrodes situated in an interdigital manner according to the present invention, in particular an electrode system made of two electrodes which are implemented in comb/finger form, and engage in one another, in particular alternately ("interdigital electrodes," IDE). The electrodes of the interdigital electrode system may be implemented and situated in the form of parallel, linear strips.

It is similarly possible according to the present invention to use one or more comb-like electrodes, optionally one or more comb-like and/or interdigital electrodes and one or more flat electrodes in combination with one another to equip one or more microfluidic channels. Flat electrodes are understood as electrodes which in particular have a continuous, uninterrupted, planar surface. The use of a flat electrode may have the advantage that it must only be coarsely adjusted in relation to a comb-like or interdigital electrode system and the assembly of the cell may therefore also be simplified. In addition, a flat electrode in combination with interdigital electrodes may possibly improve the accumulation efficiency of a flow cell.

The electrodes may be implemented and attached to the particular channel floor and/or ceiling in a known manner in planar technology. The electrodes may also be located laterally to the channel or channels, however, i.e., on the channel walls. The selection and positioning of the electrodes may advantageously be adapted to the particular requirements of the samples to be processed and in this manner the efficiency of the flow cells and the dielectrophoresis system according to the present invention may be improved.

The "ceiling" of the flow cells, i.e., of the dielectrophoretically active channels, may be understood in particular as the surface in the channel which is on top in the operating mode, in particular with respect to the direction of gravity. The "floor" of the channels may be understood in particular as the surface which is on the bottom in the operating mode, in particular with respect to the direction of gravity.

The electrodes according to the present invention are activatable independently of one another, for example, by an external control unit and/or a control unit which is integrated in the dielectrophoresis system. In particular, the electrodes of the individual channels, and therefore the dielectrophoretic force fields, may be turned on and off separately. Furthermore, the same electrode voltages may fundamentally be applied to the electrodes of the individual channels, but electrode voltages which are different from one another may also be applied. In other words, an identical dielectrophoretic force field may be produced in each of the various channels or dielectrophoretic force fields of different strengths may be produced. It is preferable according to the present invention that the produced dielectrophoretic force field is implemented identically at least within one group of microfluidic channels $K_n$ where $1 \leq n \leq N$ and $N \geq 2$. The microfluidic channel within such a group through which medium flows first in the case of a series connection is referred to by "$K_1$" in relation to the flow direction of the medium. The microfluidic channel within such a group of channels through which medium flows last in the case of a series connection is referred to by "$K_N$" in relation to the flow direction of the medium. If only one group of channels is provided according to the present invention within the microfluidic dielectrophoretic system, which may each have an identical dielectrophoretic force field, N therefore also represents the total number of the dielectrophoretically active channels.

A liquid medium having particles contained therein may be, for example, a particle suspension or a biofluid, for example, blood or urine, the latter in particular also being able to be subjected to pretreatment, for example, desalination, possibly before the performance of the dielectrophoresis.

Particles are understood according to the present invention in particular as polarizable microparticles having a size of 0.1 μm to 500 μm. However, the system according to the present invention is fundamentally not restricted thereto, but may also be adapted to smaller or larger particles, for example. For example, the particles may be synthetic polymer or silica particles and/or bioparticles, such as organelles, cells, bacteria, and/or viruses. Synthetic polymer particles may be, for example, microparticles made of latex, polystyrene, polymethylene methacrylate, or melamine resin. Synthetic polymer particles may be used as test particles for the optimization of the dielectrophoresis system, for example.

The liquid medium may be selected, for example, in particular for biotechnological applications, from water or aqueous buffer solutions which are suitable for the particular bioparticles, such as bacteria, viruses, and/or cells, but is not restricted thereto. The liquid medium may also include other solvents, for example, ethanol or methanol.

In one specific embodiment of the present invention, dielectrophoretically active channels $K_1$ to $K_N$ may be situated together on a microfluidic element, in particular a microfluidic chip. This has the advantage that the channels as flow cells and optionally their supply lines and drain lines and optionally also the valves may be produced in one manufacturing process.

Alternatively, in another embodiment of the microfluidic dielectrophoresis system according to the present invention, the dielectrophoretically active channels may be situated on different microfluidic elements. The channels may be connected to one another via flexible tubing as lines. The valves may optionally also be connected as external components in the liquid pathway.

The valves of the dielectrophoresis system according to the present invention may be pneumatic valves, for example, which may be activated and switched by an external control unit and/or a control unit integrated in the system. The valves may be activated individually or in groups to set the parallel connection and/or the series connection.

The entirety of the lines, which may be formed by microfluidic channels or by flexible tubing, for example, the dielectrophoretically active channels connected to one another thereby and the valves, are also referred to according to the present invention as the channel system.

A microfluidic flow cell according to the present invention and/or a microfluidic channel system according to the present invention, including dielectrophoretically active channels $K_1$ to $K_N$, may particularly be manufactured by microtechnology methods. For example, a plate-shaped or film-shaped substrate, for example, a glass substrate, a silicon substrate, a circuit board substrate, or a polymer substrate, in particular a Pyrex substrate, a Teflon substrate, a polystyrene substrate, a substrate made of a cycloolefin copolymer, a polyester substrate, or a PDMS substrate, or a substrate which is structured by injection molding or deep etching or embossing, in particular hot stamping, for example, a structured glass substrate, silicon substrate, or polymer substrate, in particular a Pyrex substrate, a Teflon substrate, a polystyrene substrate, a substrate made of a cycloolefin copolymer, a polyester substrate, or a PDMS substrate may be used. Electrodes may subsequently be applied thereon, for example, using thin-film technology and/or lithography. The resulting system may then be covered using a ceiling, for example, a glass plate or a polymer plate or film, in particular a PDMS film or a polystyrene or Pyrex plate, or a glass plate or polymer film or plate which is structured by injection molding or deep etching or blow molding or embossing, in particular hot stamping.

The microfluidic dielectrophoretically active channels may, for example, have a length of ≥5 mm to ≤100 mm, in particular ≥10 mm to ≤80 mm, in particular ≥20 mm to ≤60 mm, for example, 40 mm, and/or a width of ≥50 μm to ≤50 mm, in particular ≥1 mm to ≤30 mm, for example, 25 mm, and/or a height of ≥20 μm to ≤2000 μm, in particular ≥100 μm to ≤200 μm, for example, 130 μm or 150 μm.

The channel system according to the present invention of the dielectrophoresis system may have an inlet and an outlet. The channel system may be connected to a supply device via an inlet. In one specific embodiment according to the present invention of the dielectrophoresis system, the supply device may be an injector pump, a peristaltic pump, or a micropump in particular. Alternatively, the supply device may also be a sample inlet reservoir. It is also possible according to the present invention to combine the sample inlet reservoir and the particular selected pump to form a supply device. The outlet is preferably connected or connectable to a sample collection reservoir and/or to a waste reservoir. It is also possible according to the present invention to connect the outlet of the channel system to a pump which may support the flushing out of the medium and/or the particles with the aid of suction.

Polarizable synthetic particles and/or bioparticles, such as bacteria, cells, or viruses, may advantageously be accumulated and concentrated from a sample liquid flowing past by the microfluidic dielectrophoresis system according to the present invention. A high yield of accumulated bioparticles and/or a high sample throughput, for example, of several milliliters of sample liquid, as the medium having particles contained therein, may be achieved within 1 to 60 minutes, for example, 30 minutes, in particular within 5 to 15 minutes.

In a further embodiment, one or more of microfluidic dielectrophoretically active channels $K_1$ to $K_N$ may contain mixer structures. The mixer structures may induce eddies in the flow of the medium. A greater proportion of the particles entrained in the medium may therefore advantageously reach the inflow area of the dielectrophoretic force field through integration of mixer structures in a channel. The mixer structures may be situated, for example, in the form of a symmetrical or asymmetrical herringbone pattern, but are not restricted thereto. In addition, further inhomogeneities of the dielectrophoretic field may optionally be induced by such so-called "herringbone mixer structures." Both above-described effects may contribute to further improving the efficiency of the accumulation and concentration of the particles. In addition, efficient accumulation of the particles is also possible at a higher flow rate than in systems without mixer structures. In other words, the throughput of sample volume may advantageously also be increased by introduction of a suitable mixer structure in one or more, in particular all dielectrophoretically active channels.

In one specific embodiment of the present invention, the microfluidic channels which are equipped with electrodes may be implemented as at least two groups, one of which is connected downstream from the other in the flow direction of the medium, $K_{n,A}$ where $1 \leq n \leq N$ and $N \geq 2$ and $K_{m,B}$ where $1 \leq m \leq M$ and $M \geq 2$, groups of channels $K_{1,A}$ to $K_{N,A}$ and $K_{1,B}$ to $K_{M,B}$ being able to be operated at different electrode voltages, for example, different frequencies and/or amplitudes. In other words, the dielectrophoresis system according to the present invention may have at least two groups of dielectrophoretically active channels, in which different dielectrophoretic force fields may be produced. In this manner, during an accumulation phase in which the flow cells are operated in parallel, different polarizable particles may advantageously be collected simultaneously each in the dielectrophoretic "field cages" of the active channels associated with the two groups. "$K_{1,A}$" and "$K_{1,B}$" refer to the channel within the particular group through which the medium first flows in relation to the flow direction of the medium in the case of a series connection of the microfluidic dielectrophoretically active channels. "$K_{N,A}$" and "$K_{M,B}$" refer to the channel within such a group of channels through which the medium last flows in relation to the flow direction of the medium in the case of a series connection. For example, if two groups of dielectrophoretically active channels are provided according to the present invention within the dielectrophoresis system according to the present invention, which may each have an identical dielectrophoretic force field, sum N+M represents the total number of the dielectrophoretically active channels. However, the dielectrophoresis system according to the present invention is not restricted to only two such above-described groups of channels.

The present invention further relates to a method for dielectrophoresis, in particular for the accumulation and/or concentration of polarizable particles from a liquid medium, in particular using a microfluidic dielectrophoresis system, at least including

- one supply device for a liquid medium having particles contained therein,
- $N \geq 2$ microfluidic, dielectrophoretically active channels $K_n$, which are equipped with electrodes, where $1 \leq n \leq N$,
- lines for the fluidic connection of the supply device to the channels, for the connection of the channels to one another, and for the drainage of the medium and/or the particles from the channels, and
- valves for setting the flow direction of the medium in the lines, the dielectrophoretically active channels being situated and being connected by lines in such a way that they may be operated connected in parallel and in series by switching the valves in relation to the flow direction of the medium and the electrodes of the various channels are activatable independently of one another, including A) an accumulation phase, including the following steps
- aa) switching the valves to a parallel connection of the channels,
- ab) supplying medium having particles contained therein to channels $K_1$ to $K_N$, ac) accumulating the particles in channels $K_1$ to $K_N$, an AC voltage being applied to the electrodes for the accumulation of the particles B) a concentration phase, including the following steps ba) switching the valve to a series connection of channels K1 to KN, bb) releasing the accumulated particles by selectively turning off the electrodes of channels Kn where $1 \leq n \leq N-1$, bc) transporting the released particles in and/or through particular downstream channels Kn+1, and bd) collecting the particles in channel KN and C) flushing the collected particles out of channel $K_N$.

During accumulation phase A), a high-frequency AC voltage, for example, of 15 V to 50 V, for example, 30 V, having a frequency of 0.5 MHz to 1.5 MHz, for example, 1 MHz, may be applied to the electrodes to produce an inhomogeneous electrical field. A solution or suspension including polarizable particles, for example, bioparticles, may be conducted, in particular pumped, through the dielectrophoretically active channels connected in parallel. The type and strength of the dielectrophoretic force field may be adapted to the particular particles to be accumulated. The parallel connection of the channels allows a high throughput of sample volume and a high flow rate according to the present invention, in addition to the efficient accumulation of the particles.

In concentration phase B), through the possible series connection of the channels and the independent control of the electrodes and thus of the individual dielectrophoretic force fields, it may be possible to selectively release the particles accumulated in the individual channels by selectively turning off the voltage on the electrodes and to collect them in one or more channels, in which the dielectrophoretic force is still active. The particles which are thus accumulated and concentrated once again may be flushed out from this channel or these channels in collected form. In other words, an additional concentration effect may be achieved according to the present invention in a separate phase B).

The particles concentrated in channel $K_N$ may be flushed out in collected form in step C). The final flushing of the particles out of channel $K_N$ may advantageously be performed using a smaller volume of eluent in comparison to the volume of the sum of all dielectrophoretically active channels. The efficiency of the concentration may thus be increased once again in this manner.

For example, the liquid medium may be used as the eluent for flushing the particles out of the channel system, in particular channel $K_N$, through which the medium flows last in the case of a series connection. However, the eluent may also be different from the medium and may be selected, for example, from water or, in particular for bioparticles, such as bacteria, viruses, and/or cells, suitable aqueous buffer solutions or other solvents suitable for the particles.

In one embodiment variant of the method according to the present invention, the steps of concentration phase bb) releasing the accumulated particles in channel $K_n$ and bc) transporting the released particles into particular downstream channel $K_{n+1}$ may be performed by successively turning off the electrodes, i.e., turning off the applied voltage in channels $K_1$ to $K_{N-1}$, in particular beginning with channel $K_1$, through which the medium flows first in the case of a series connection. The cycle of turning off the electrode voltage and releasing the particles in channel $K_n$ and transporting and accumulating the particles in particular downstream channel $K_{n+1}$ is then repeated N−1 times.

The present invention also includes that before the particles are flushed out in step C) or after channel $K_N$ is flushed out, the particles may be subjected to further process steps, in the case of cells or bacteria, for example, lysis and/or a detachment phase, in particular a DNA/RNA exposure phase. In other words, the method according to the present invention may further include a lysis phase, for example. During the lysis phase and/or detachment phase, a low-frequency AC voltage, for example, of ≥30 V to ≤50 V having a frequency of ≥1 kHz to ≤20 kHz, for example, 10 kHz, may be applied to the electrodes of an interdigital electrode system. The pumping of the solution or suspension which includes polarizable bioparticles may be stopped during the lysis phase. The lysis may also be performed chemically, in particular by the use of detergents, for example, sodium dodecylsulfate, or by chaotropic salts, for example, of guanidine thiocyanate. Following the lysis phase, the lysate may then be flushed out and/or used further appropriately.

In another embodiment of the method according to the present invention, dielectrophoretically active channels $K_n$, which are equipped with electrodes, may be operated in at least two groups, one of which is connected downstream from the other in the flow direction of the medium, $K_{n,A}$, where $1 \leq n \leq N$ and $N \geq 2$ and $K_{m,B}$ where $1 \leq m \leq M$ and $M \geq 2$, using electrode voltages of different frequencies and/or amplitudes. Through this division or grouping it is advantageously possible to accumulate at least two different types of particles simultaneously within one accumulation phase A). In this manner, various particles may advantageously be collected for a subsequent analysis, for example, for whose accumulation different frequencies are required, for example.

In a further embodiment variant of the method, in which at least two groups $K_{n,A}$ and $K_{m,B}$, one of which is connected downstream from the other in the passage direction, are used for the concentration of particles, the particles may each be collected in channels $K_{N,A}$ and $K_{M,B}$ of the groups, through which the medium flows last in the case of a series connection. Channels $K_{N,A}$ and $K_{M,B}$ may then be flushed out simultaneously or in sequence in a step CA) and CB).

The variant of the flushing which is selected may advantageously be adapted to the particular requirements. Simultaneous flushing may be expedient, for example, if the particles may be jointly analyzed and/or further processed after completed dielectrophoresis. However, if the particles are subsequently to be analyzed and/or further treated separately from one another, they may be flushed out successively, for example, into separate sample collection reservoirs.

Furthermore, the present invention relates to the use of a microfluidic dielectrophoresis system according to the present invention in medical technology and/or microbiology, for example, in medical analytics, in particular in an integrated microfluidic lab-on-a-chip system, for example, for sample pretreatment, in particular for a DNA and/or RNA analytics or the analysis of proteins.

FIG. 1 shows a dielectrophoresis system 1 according to the present invention including microfluidic dielectrophoretically active channels $K_1$ to $K_N$ ($N \geq 2$). Channels $K_1$ to $K_N$ are each equipped with electrodes (not shown), which produce an inhomogeneous electrical field in channels $K_1$ to $K_N$ at least in a partial area. Polarizable particles, for example, bacteria, viruses, cells, or also polymer particles, which are contained in a liquid medium flowing through the particular channel, may be held back and accumulated by the dielectrophoretic force field thus produced. Channels $K_1$ to $K_N$ are connected to one another by lines 2 and are in contact with a supply device 3 for the medium having the particles contained therein, for example, an injector pump or micropump. The runway of the medium in lines 2 may be set via valves $a_{ij}$ and $b_i$. Only valves $a_{11}$, $a_{21}$ in lines 2*a*, which supply the medium to channels $K_1$ and $K_2$, and valves $a_{12}$ and $a_{22}$ in lines 2*b*, which drain medium out of the channels, and valves $b_1$ and $b_2$ are shown for the sake of clarity. Valves $a_{ij}$ and $b_i$ may either be integrated in a microfluidic channel system or may be switched into the passage pathway of the medium as external components via tubing as lines 2, 2*a*, 2*b*. Channels $K_1$ to $K_N$ are interconnected with one another according to the present invention in such a way that they may be operated connected in parallel or in series in relation to the flow direction of the medium by switching valves $a_{ij}$ and $b_i$. In a first accumulation phase A) shown here, channels $K_1$ to $K_N$ may be connected in parallel to collect particles. Valves $a_{ij}$, in the shown specific embodiment valves $a_{12}$ and $a_{22}$, are switched through for this purpose, while valves $b_i$, in the shown specific embodiment $b_1$ and $b_2$, are blocked. Channels $K_1$ to $K_N$ may thus have liquid medium having particles, for example, a particle suspension, flowing through them simultaneously. In each channel $K_1$ to $K_N$, the particles contained in the medium may be held back and accumulated. This advantageously allows the throughput of a large sample volume and a high total flow rate through the dielectrophoresis system according to the present invention. One or more of microfluidic dielectrophoretically active channels $K_1$ to $K_N$ may additionally contain mixer structures (not shown). Through integration of mixture structures in a channel, a greater proportion of the particles entrained in the medium may advantageously reach the inflow area of the dielectrophoretic field. The accumulation and concentration of the particles may thus be further improved.

Figure 2:
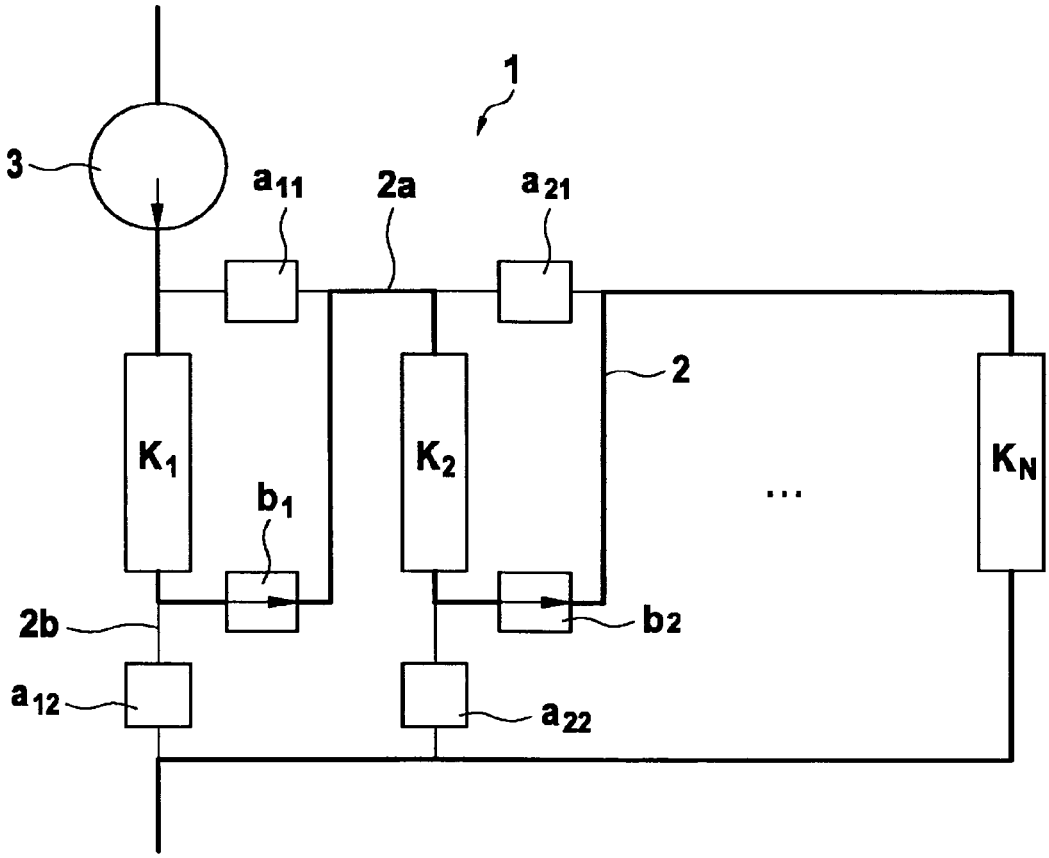
FIG. 2 shows a schematic view of a microfluidic dielectrophoresis system according to the present invention from FIG. 1 having channels connected in series.

FIG. 2 shows a schematic view of microfluidic dielectrophoresis system 1 according to the present invention shown in FIG. 1, channels $K_1$ to $K_N$ being connected in series in relation to the medium flowing through in a second concentration phase B). For this purpose, valves $a_{ij}$ are blocked, while valves $b_i$, i.e., valves $b_1$ and $b_2$, are switched to flow-through. The electrode voltage and thus the dielectrophoretic force acting on the particles may be turned off selectively in channels $K_1$ to $K_{N-1}$. The particles accumulated in channels $K_1$ to $K_{N-1}$ may be released by selectively turning off the dielectrophoretic force and may particularly be concentrated in channel $K_N$ through which the medium flows last or in the first channel in the flow direction in which the dielectrophoretic force is still active. The electrode voltage may advantageously also be turned off successively, for example, beginning with channel $K_1$ first having medium flowing through it. The particles are transported into downstream channel $K_2$, in which the dielectrophoretic force is still active. The particles are held there, until the electrode voltage is also turned off in channel $K_2$. This cycle of turning off the electrode voltage and releasing the particles in channel $K_n$ and transporting and accumulating the particles in particular downstream channel $K_{n+1}$ is repeated a total of N−1 times. The particles concentrated in channel $K_N$ may then be flushed out in collected form. The final flushing of the particles out of $K_N$ may advantageously be performed using a comparatively small volume of eluent. An additional concentration effect may thus be achieved in this manner.

In summary, a dielectrophoresis system is provided according to the present invention, using which in particular the efficiency of the concentration of synthetic, in particular polymer particles, for example, made of latex or polystyrene, or biological particles, for example, bacteria, viruses, or cells, from a liquid medium may be improved. In particular, additional concentration of the particles may be made possible by the interconnection according to the present invention of the dielectrophoretically active channels. Moreover, a smaller volume of eluent is required during the final flushing out of the particles, which further improves the achievable concentration factor of the particles in relation to microfluidic systems and methods known heretofore.

What is claimed is:

1. A method for dielectrophoresis for concentrating particles from a liquid medium using a microfluidic dielectrophoresis system, wherein the microfluidic dielectrophoresis system includes: a supply device for a liquid medium having particles contained therein; N≥2 microfluidic, dielectrophoretically active channels ($K_n$, where 1≤n≤N), which are equipped with electrodes; lines for fluidic connection of the supply device to the channels ($K_n$), for connection of the channels ($K_n$) to one another, and for drainage of the medium or the particles from the channels ($K_n$); and valves for setting a flow direction of the medium in the lines; wherein the dielectrophoretically active channels ($K_1$ to $K_N$) are situated and are connected by lines in such a way that they may be operated connected in parallel or in series by switching the valves in relation to the flow direction of the medium, and the electrodes of the various channels ($K_1$ to $K_N$) are activatable independently of one another;

the method comprising:

A) an accumulation phase, including the following steps:

aa) switching the valves ($a_{ij}$, $b_i$) to a parallel connection of the channels ($K_1$ to $K_N$), ab) supplying medium having particles contained therein to the channels ($K_1$ to $K_N$), ac) accumulating the particles in the channels ($K_1$ to $K_N$), a high-frequency AC voltage being applied to the electrodes;

B) a concentration phase following the accumulation phase, the concentration phase including the following steps;

ba) switching the valves ($a_{ij}$, $b_i$) to a series connection of channels ($K_1$ to $K_N$), bb) releasing the accumulated particles by turning off the electrodes of the channels ($K_1$ to $K_{N-1}$), bc) transporting the released particles in or through the particular downstream channels ($K_{n+1}$ to $K_N$), and bd) collecting the particles in the channel ($K_N$)

and

C) flushing the collected particles from the concentration phase out of the channel $K_N$.

2. The method as recited in claim 1, wherein the concentration steps bb) releasing the accumulated particles in the channel ($K_N$) and bc) transporting the released particles into the particular downstream channel ($K_{n+1}$) are performed by successively turning off the electrodes in the channels ($K_1$ to $K_{N-1}$), beginning with the channel ($K_1$) through which the medium flows first.

3. The method as recited in claim 1, wherein the microfluidic dielectrophoretically active channels ($K_n$), which are equipped with electrodes, are operated in at least two groups ($K_{n,A}$ where 1≤n≤N and N≥2) and ($K_{m,B}$ where 1≤m≤M and M≥2), which are connected one downstream from the other in the flow direction, using electrode voltages of different frequencies or amplitudes.

4. The method as recited in claim 2, wherein the microfluidic dielectrophoretically active channels ($K_n$), which are equipped with electrodes, are operated in at least two groups ($K_{n,A}$ where 1≤n≤N and N≥2) and ($K_{m,B}$ where 1≤m≤M and M≥2), which are connected one downstream from the other in the flow direction, using electrode voltages of different frequencies or amplitudes.

5. The method as recited in claim 3, wherein the concentration of particles is performed in each case in the last channels ($K_{N,A}$ and $K_{N,B}$) of the groups through which medium flows, and these channels ($K_{N,A}$ and $K_{N,B}$) are flushed out simultaneously or successively in a step CA) and CB).

6. The method as recited in claim 4, wherein the concentration of particles is performed in each case in the last channels ($K_{N,A}$ and $K_{N,B}$) of the groups through which medium flows, and these channels ($K_{N,A}$ and $K_{N,B}$) are flushed out simultaneously or successively in a step CA) and CB).

7. The method as recited in claim 1, wherein the valves are pneumatic valves, and wherein the pneumatic valves are switched by a control unit of the microfluidic dielectrophoresis system.

* * * * *